US006612401B1

(12) United States Patent
Price et al.

(10) Patent No.: US 6,612,401 B1
(45) Date of Patent: Sep. 2, 2003

(54) SAWHORSE AND BRACKETS

(76) Inventors: Tommy Price, P.O. Box 642, Sulligent, AL (US) 35586; Charles W. Nolen, Jr., P.O. Box 190, Fayette, AL (US) 35555

( * ) Notice: Subject to any disclaimer, the term of this patent is extended or adjusted under 35 U.S.C. 154(b) by 0 days.

(21) Appl. No.: 09/898,270

(22) Filed: Jul. 3, 2001

(51) Int. Cl.[7] ..... E04G 1/00; E04G 1/34; E04G 1/32

(52) U.S. Cl. ..... 182/186.3; 182/186.5; 182/153; 182/224; 248/163.1; 248/188; D25/67

(58) Field of Search ..... 182/153, 151, 182/181.1, 225, 224, 182.4, 155, 186.5, 186.2, 186.1; D25/67; 403/187, 188; 248/188.1, 188.8, 188, 165, 300, 163.1, 440.1

(56) References Cited

U.S. PATENT DOCUMENTS

| | | | | | |
|---|---|---|---|---|---|
| 302,945 | A | | 8/1884 | Sargent | |
| 936,945 | A | | 10/1909 | Rice | |
| 1,542,048 | A | | 6/1925 | Forester | |
| 1,597,555 | A | * | 8/1926 | Tolmie | 182/224 |
| 1,953,012 | A | | 3/1934 | Gerrard | |
| 2,501,656 | A | | 3/1950 | Anderson | |
| 3,042,144 | A | | 7/1962 | Larson | |
| 3,289,789 | A | * | 12/1966 | Larson | 182/153 |
| 3,329,239 | A | * | 7/1967 | Chesney | 182/153 |
| 3,530,956 | A | * | 9/1970 | Jadek | 182/153 |
| 3,858,682 | A | | 1/1975 | Larson | |
| 4,192,406 | A | | 3/1980 | Mitchell | |
| 4,890,952 | A | | 1/1990 | Jones | |
| 5,125,478 | A | * | 6/1992 | Henningsen | 182/153 |
| 5,377,780 | A | | 1/1995 | Dunaway | |
| 5,484,037 | A | | 1/1996 | Neumarkel | |

* cited by examiner

*Primary Examiner*—Daniel P. Stodola
*Assistant Examiner*—Hugh B. Thompson
(74) *Attorney, Agent, or Firm*—Karen B. Tripp; Elizabeth Layman

(57) ABSTRACT

A sawhorse is disclosed that provides stability, easy assembly and disassembly, and ability to handle heavy loads and is inexpensive to manufacture. Brackets that have a C-shaped collar for holding the ends of a cross member and leg receptacles for holding standard dimension lumber used for legs of the sawhorse. All pieces are designed to spread the forces of the load. An optional elevation bar helps facilitate the cutting of material without cutting through the sawhorse.

14 Claims, 4 Drawing Sheets

SAWHORSE AND BRACKETS

FIELD OF THE INVENTION

This invention relates to a sawhorse assembly. More particularly, the invention relates to a bracket assembly for use in a sawhorse, barricade and/or scaffolding type devices.

BACKGROUND OF THE INVENTION

Although the original use for a sawhorse was to provide a rack to support something being sawed, today's professional construction workers, farmers and home hobbyists use sawhorse type devices to create a work surface, a raised storage surface, a barricade, scaffolding and other similar support structures as well as to support items to be sawed. All further references to sawhorses are meant to include barricades, scaffolding and other similar structures.

Many sawhorse brackets have been developed over the years but each seems to specialize in only one primary aspect of the bracket and none have all of the desired features. Typical users, such as construction workers and farmers, want a sawhorse that provides many different features. For the busy worker, quickness and ease of assembling and disassembling the sawhorse without any tools is important. For the worker who is using the sawhorse as a support structure for cutting lumber or other materials, it is highly desirable that the structure of the sawhorse itself (both bracket and cross member) be protected from the saw blade.

The capability of handling heavy loads is important, especially in commercial construction. Stability and durability come into play when the pieces of the sawhorse are put together. Each piece needs to be designed such that it disperses the stress forces across as broad an area as possible to provide maximum support with minimum stress on each piece. An example of this is the fitting of the wooden legs flush against the bracket to spread the load stress points over an extended area.

Everyone is interested in low cost; and, therefore, the product should be easy to manufacture and the lumber that is used for the legs and cross member should be reusable for other things—they should not be fungible goods. Construction sights are not known for gentleness and any tool or device that is intended for use on-site must be able to withstand rough treatment.

Although there are several sawhorse brackets on the market, none have all of the desired features as described above. For example, U.S. Pat. No. 4,192,406 by Mitchell does not meet the above requirements for several reasons. First, the complex requirements of the manufacturing process (using a single, integral sheet of stiff bendable material, cutting all the required intricate patterns and then bending all of the lips, tabs and securement flaps into place) greatly increase the cost of manufacturing and limit the thickness of the material that can be used. This would possibly limit the amount of load that the sawhorse can handle at an amount less than desired.

Additionally, Mitchell's '406 patent uses only two spaced tabs (cut and bent from the side walls) to support each end of the cross member which must handle all forces of the load. When the sawhorses are loaded to a high, desired capacity, the stress forces will tend to cause the metal to distort. This distortion makes the sawhorse unstable and causes problems with disassembly and reassembly operations. The load factors must be dispersed through a broader area to prevent this type of problem. Similarly, the stops that are located in the leg segments also are bent tabs which are susceptible to being forced upward when a load is applied to the sawhorse, thus defeating the purpose of the stops to have the tops of the wooden legs fit flush against metal in the bracket.

U.S. Pat. No. 5,484,037 by Neumarkel also does not meet the set of requirements outlined above. Although the '037 patent discloses an elevated cross member, the elevation does not appear to be enough so that a saw blade will not encounter the metal brackets. The '037 patent also does not disclose nor discuss the protection of the cross member itself. Similarly, it appears that the lumber for the legs must be cut at angles such that the legs fit flush against the top member. By cutting the lumber, the lumber is no longer totally reusable as desired. If the lumber for the legs is not cut, the leg will only contact the bottom of the sleeve along one edge of the sleeve so all forces of the leg pushing upward are now focused on a single line instead of a broader area.

The stability of the '037 design is also of concern. The bottom of the sleeve is positioned on top of the intersection of the two leg sockets and overlaps each leg by less than one-half the width of the leg. This intersection of the two legs and the center tube is welded. This single weld point does not appear to provide sufficient stability especially when considering that the bottom of the center sleeve receives the full force of the load from the top and receives the pressure of the two wooden legs pushing upwardly through the leg sockets. Therefore, when a load is placed on the sawhorse, the forces press downward on the bottom of the tube and the legs tend to spread outward while the top ends of the legs tend to push up through the leg sockets with pressure on the top member. If the pressure from the two legs is uneven, there would be a tendency for the weld to weaken or break. Marketing literature for the '037 design only rates the bracket at 750 pounds. This is not acceptable for many commercial and farm uses.

The cost of manufacturing tubing as opposed to flat metal also is much higher and any openings in the tubing must be made by drilling which is more expensive than a method such as punching which can be used on flat metal. The use of standard tubing also presents the problem of improper fit. The lumber used for the legs, as shown in the published patent, is not tightly encased by the tubing. This means that the legs will flex within the tubing causing continual wear on the wooden legs. Another concern of using tubing relates to the corners. Because the corners of the tubing are rounded and the corners of the lumber used for the legs and support piece are squared, the tubing cannot provide the desired flush fitting of the pieces.

In general, the approach of the art has been to focus on a particular aspect and none of the above-described brackets or others found in the prior art have been able to adequately handle heavy loads on easy-to-assemble/disassemble sawhorses that are easy and inexpensive to manufacture and do not treat the lumber used for the cross member and legs as fungible goods. It would, therefore, be a significant advancement in the art to provide an improved sawhorse bracket that provides all of these features.

SUMMARY OF THE INVENTION

Accordingly, this invention is directed to an improved sawhorse bracket that is easy and inexpensive to manufacture, does not require the more-expensive metal tubing used in the prior art, uses standard dimension lumber for the cross member and legs, does not require the trimming of the lumber for the legs to fit flush against the bracket, is easily assembled and disassembled, provides away to elevate materials that are being cut such that the saw blade cannot damage the sawhorse bracket or cross member, and is capable of handling heavy loads.

In fulfillment of the objectives stated above, the present invention is directed to an improved sawhorse. The present invention accomplishes this objective by using a structure comprising four legs, a cross member having two ends, and two brackets wherein each bracket has a C-shaped collar which is adapted to receive one of the ends of the cross member and two leg receptacles which are attached to a front side and a back side of the collar, wherein each of the leg receptacles is adapted to receive one of the four legs of the sawhorse.

DESCRIPTION OF THE PREFERRED EMBODIMENT

Figure 1:
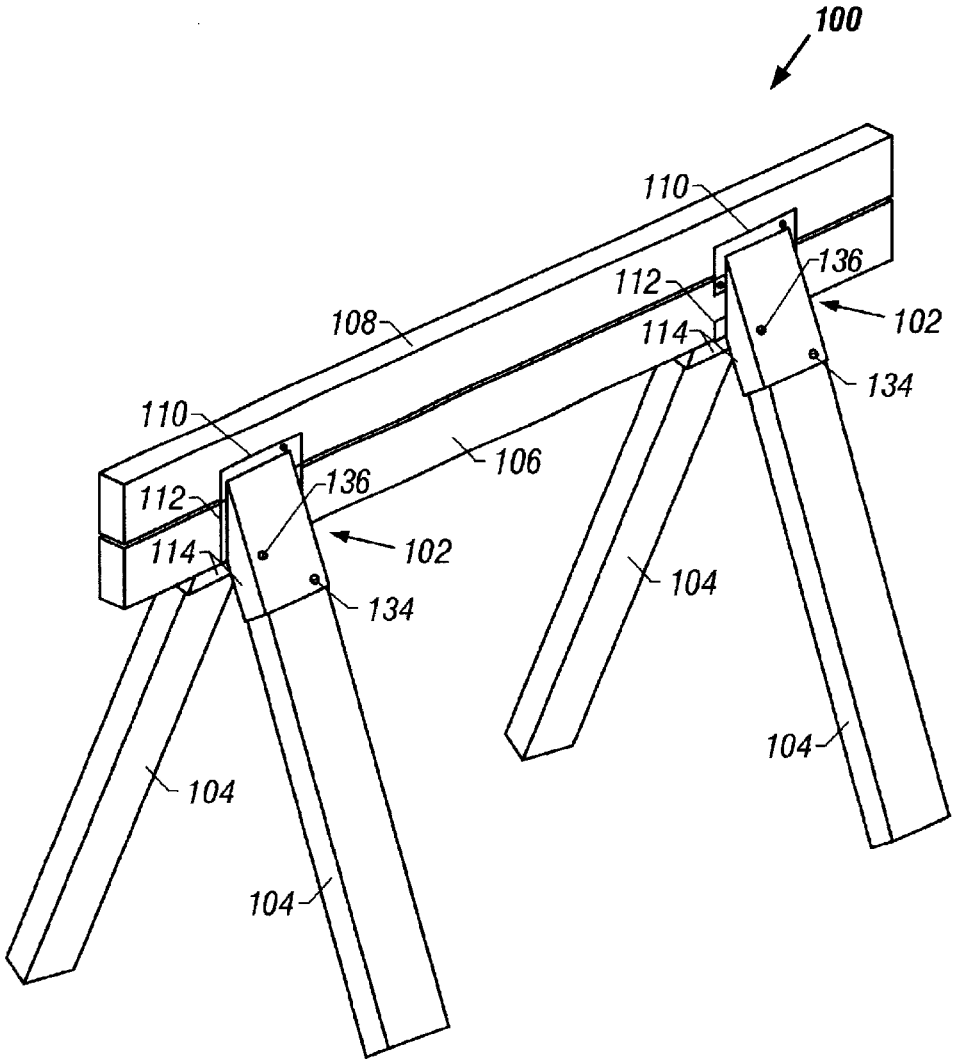
FIG. 1 is a perspective view of an assembled sawhorse using two brackets of the present invention.

FIG. 1 discloses a typical sawhorse 100 assembled with two brackets 102, four standard dimension 2×4 pieces of lumber for the legs 104, a cross member 106 and an elevation bar 108.

In this embodiment the elevation bar 108 is a standard dimension 2×4 piece of lumber. Other sizes can be used such as 2×2 and 2×6 depending on the type of lumber available and the type of work being done.

Figure 2:
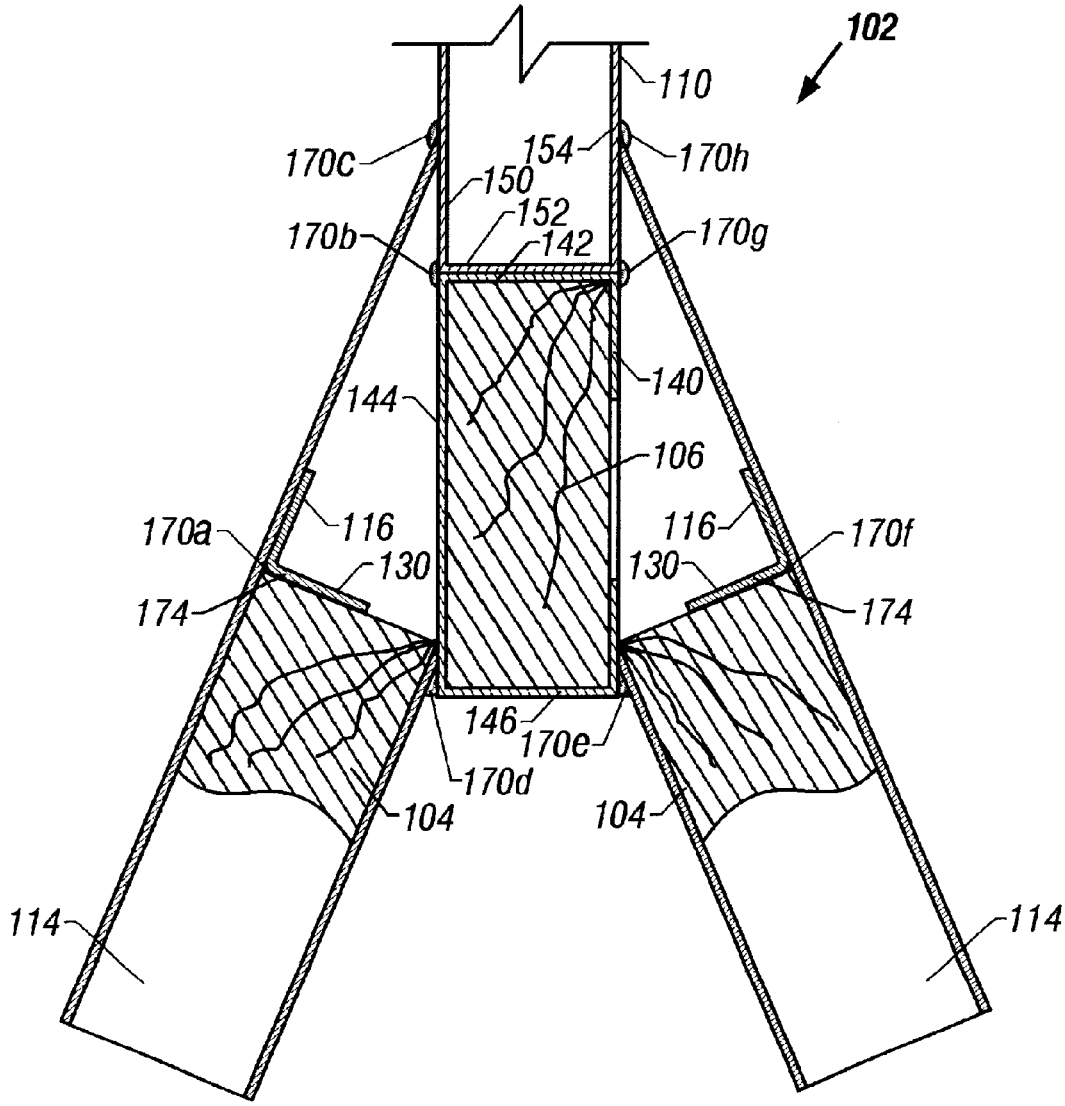
FIG. 2 is an end view of a bracket of the present invention with a cross member in place.

Turning now to FIG. 2, the bracket 102 is shown from an end view. The cross member 106 and parts of the legs 104 are shown to illustrate the assembly of the sawhorse 100. To best understand the elements of the bracket 102, a brief description of a method of manufacturing the bracket 102 is disclosed. For this embodiment, all of the elements of the bracket 102 are made from 14 gauge flat stock metal. This is meant as way of example and is not meant to limit the scope of the invention. The elements can be made and assembled in any sequence that facilitates the manufacturing process. The elements of the bracket of the invention include a cradle 110, a collar 112 and two leg members 114.

Figure 3:
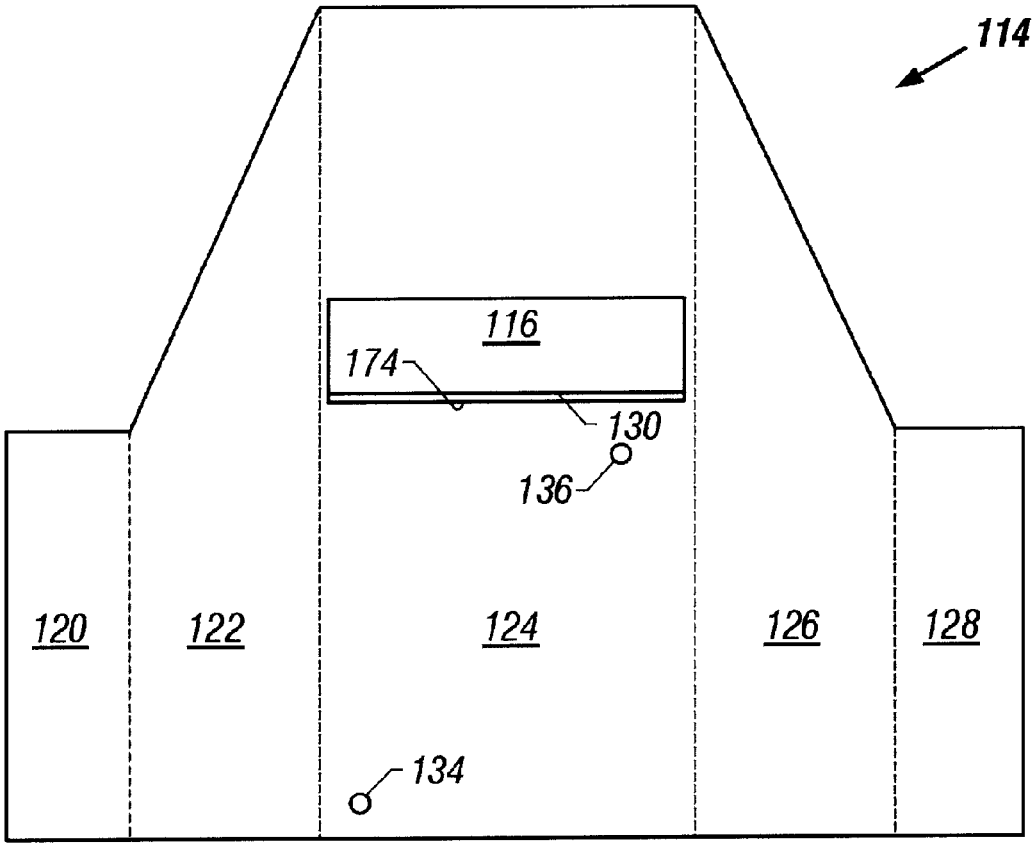
FIG. 3 is a plan view showing a blank of the present invention adapted to form a leg element of the bracket of the present invention and with a leg stop attached.

One leg member 114 is formed for each side of the bracket 102 by cutting a piece of metal ta into the shape shown in the inside view of the leg member 114 in FIG. 3. The parts of the leg member 114 are labeled as follows: a first inner portion 120, a first side 122, a front 124, a second side 126 and a second inner section 128. Leg retention holes 134 and 136 can be punched into the front 124 of the leg member 114 as shown in FIG. 3.

In this embodiment, a leg stop 116 is formed by bending a rectangular piece of metal and attaching it to the inside of the front 124 of the leg member 114 as shown in FIGS. 2 and 3. The leg stop 116 is attached to the leg member 114 such that the bottom 130 of the leg stop 114 is approximately half way between the top and bottom of the front 124 of the leg member 114. The width of the leg stop 116 is slightly less than the width of the front 124 of the leg member 114 as shown in FIG. 3. The depth of the bottom 130 of the leg stop 116 of this embodiment is approximately two-thirds of the depth of the second side 126 of the leg member 114, as shown in FIG. 2. These dimensions are approximate and are meant as examples without limiting the scope of the invention.

The leg stop 116 provides a flat surface 174 to receive the flat surface of one end of the leg 104 thus providing flush surface-to-surface contact between the bracket 102 and the leg 104. This provides maximum strength without having to trim the end of the leg 104.

Figure 5:
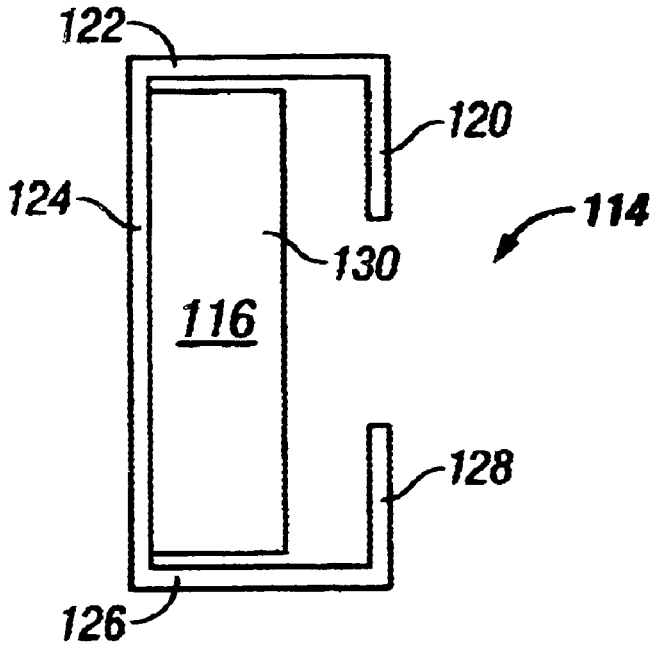
FIG. 5 is a bottom view of a formed leg member of the bracket of the present invention.

The leg member 114 with the leg stop 116 attached is now bent (along the dashed lines shown in FIG. 3) into a squared-C-shaped member as shown in FIG. 5.

Figure 4:
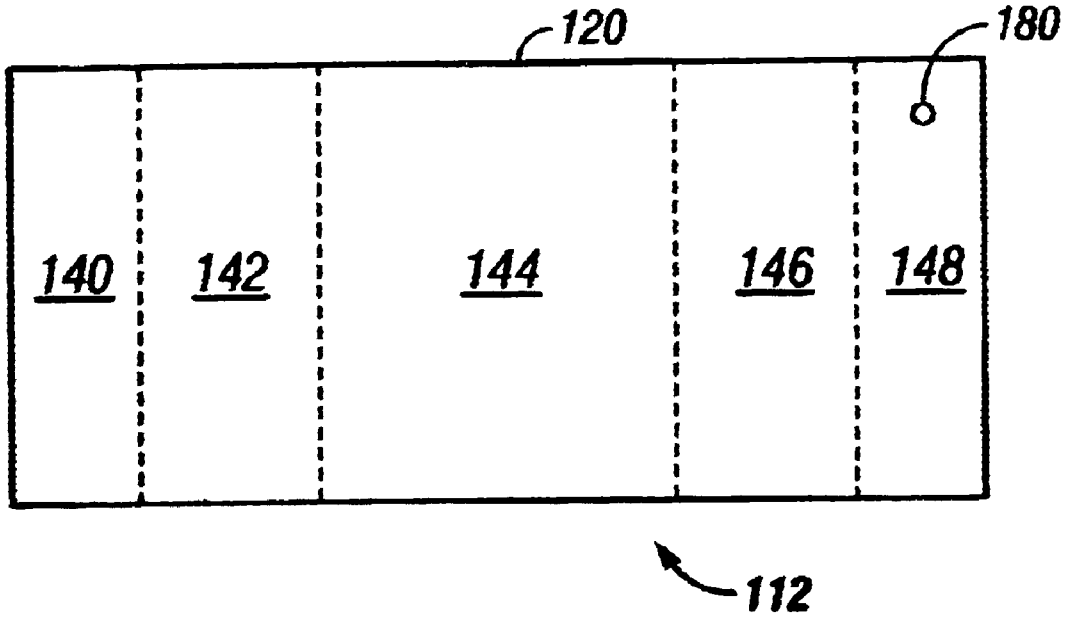
FIG. 4 is a plan view showing a blank of the present invention adapted to form a collar of the bracket of the present invention.

The collar 112 in this embodiment is formed from a piece of metal cut in a rectangular shape as shown in FIG. 4. Any desired retention holes 180 can be punched into the collar 112 prior to bending the piece along the dashed lines indicated in FIG. 4, as shown in FIG. 2, such that the collar 112 has a top overhang 140, a top 142, a back 144, a bottom 146 and a bottom overhang 148.

The cradle 110, as shown in FIG. 2, is formed from a piece of metal into a squared-U-shaped element with a bottom 52 wide enough to receive the narrower side of a standard dimension 2×4 piece of wood and with a length slightly longer than the width of the leg member 114, as seen in FIG. 1. The cradle 110 includes a first side 150, the bottom 152 and a second side 154.

The elements of the bracket 102 are now attached as shown in FIG. 2. The elements in this embodiment are welded together at weld points 170 a–h. This method of attachment is meant by way of example and is not intended to limit the scope of the claims.

In assembling the sawhorse 100, a simple calculation determines the approximate length of the legs 104. The length of the legs 104 is equal to the desired height of the sawhorse 100 minus five.

It is anticipated that those skilled in the art of bracket technology will recognize various other ways of manufacturing the invention and other uses of the invention. While the invention has been particularly shown and described with reference to the preferred embodiment thereof, it will be understood by those skilled in the art that various changes in form and detail may be made therein without departing from the scope of the invention, as set forth in the following claims.

We claim:

1. A sawhorse comprising:

a. four legs;

b. a cross member having two ends; and c. two brackets, each of the brackets comprising:

a C-shaped collar adapted to receive one of the ends of the cross member, the collar comprising a top overhang, a top, a back, a bottom and a bottom overhang;

a cradle attached to the top of the collar;

two leg receptacles, wherein one of the leg receptacles is attached to the cradle and the bottom overhang of the collar and the other leg receptacle is attached to the back of the collar and wherein each of the leg receptacles is adapted to receive one of the legs of the sawhorse.

2. The sawhorse of claim 1, wherein the legs are standard-dimension 2×4 lumber.

3. The sawhorse of claim 1, wherein the cross member is standard-dimension 2×4 lumber.

4. The sawhorse of claim 1 further comprising an elevation bar and where the cradle is adapted to receive an end of the elevation bar.

5. The sawhorse of claim 4, wherein the legs, the cross member and the elevation bar are all standard-dimension 2×4 lumber.

6. The sawhorse of claim 1, further comprising a leg stop attached inside each leg receptacle for flushly receiving the leg.

7. The sawhorse of claim 6, wherein the leg stop is positioned approximately half way between the top and bottom of the leg receptacle.

8. The sawhorse of claim 1, wherein the length of the legs, in inches, is approximately the desired height, in inches, of the top of the sawhorse minus five inches.

9. The sawhorse of claim 1 wherein the leg receptacle attached to the bottom overhang is further attached to the top overhang of the collar.

10. A bracket for each end of a sawhorse, wherein the sawhorse comprises four legs and a cross member having two ends and wherein each bracket comprises:

(a) a C-shaped collar adapted to receive one of the ends of the cross member, the collar comprising a top overhang, a top, a back, a bottom and a bottom overhang;

(b) a cradle attached to the top of the collar; and (c) two leg receptacles wherein one of the leg receptacles is attached to the cradle and the bottom overhang of the collar and the other leg receptacle is attached to the back of the collar and wherein each leg receptacle is adapted to receive one of the legs of the sawhorse.

11. The bracket of claim 10, wherein the sawhorse further comprises an elevation bar and the bracket further comprises a cradle attached to the top of the collar, wherein the cradle is adapted to receive an end of the elevation bar.

12. The bracket of claim 10, wherein the legs and cross member are standard-dimension 2×4 pieces of lumber.

13. The bracket of claim 10, further comprising a leg stop attached inside each leg receptacle and adapted to flushly receive the end of the leg.

14. The sawhorse of claim 10 wherein the leg receptacle attached to the bottom overhang is further attached to the top overhang of the collar.

* * * * *